US005800076A

United States Patent [19]

Umeda

[11] Patent Number: 5,800,076

[45] Date of Patent: Sep. 1, 1998

[54] PRINTER HAVING GUIDE PLATE EXTENDING TO PRINTHEAD

[75] Inventor: Takaichiro Umeda, Nagoya, Japan

[73] Assignee: Brother Kogyo Kabushiki Kaisha, Nagoya, Japan

[21] Appl. No.: 936,999

[22] Filed: Sep. 25, 1997

[30] Foreign Application Priority Data

Sep. 26, 1996 [JP] Japan ..... 8-254752

[51] Int. Cl.[6] ..... B41J 13/10

[52] U.S. Cl. ..... 400/645.3; 400/645; 400/642; 271/274

[58] Field of Search ..... 400/642, 645, 400/643.3, 45.4, 645.5, 635, 609.1; 271/274, 273

[56] References Cited

U.S. PATENT DOCUMENTS 4,997,179 3/1991 Mizutani et al. ..... 271/306
5,516,222 5/1996 Debruin et al. ..... 400/645.4
5,527,123 6/1996 Jackson et al. ..... 400/642
5,569,724 10/1996 Kato ..... 400/605

*Primary Examiner*—Edgar S. Burr
*Assistant Examiner*—Dave Ghatt
*Attorney, Agent, or Firm*—Oliff & Berridge, PLC

[57] ABSTRACT

A sheet is fed to a printing zone of a printhead by a feed roller and a pressure roller. An elastic sheet guide plate is joined to a lever supporting the pressure roller. The guide plate comes into contact with the feed roller upstream from a nip defined by the feed roller and the pressure roller. A nip between the conveying roller and the guide plate allows to register the sheet. The sheet, after having passed through the nip formed between the conveying roller and the guide plate, is directed to the printing zone of the printhead by the guide plate. As the guide plate extends from the printhead side end portion of the lever to a position just before the printhead, the sheet trailing edge is prevented from interfering with the printhead. Ink will not soil the sheet trailing edge, and, it is possible to achieve a high quality printing to a position extremely nearby the sheet trailing edge by using the guide plate.

21 Claims, 7 Drawing Sheets

PRINTER HAVING GUIDE PLATE EXTENDING TO PRINTHEAD

BACKGROUND OF THE INVENTION

1. Field of the Invention

The present invention relates to a printer, and specifically a printer having a guide plate extending to a printhead.

2. Description of the Related Art

An ink jet printer having a printing mechanism as shown in FIG. 7 has been known. The ink jet printer is provided with a feed roller 94 and a pressure roller 96 disposed upstream from a printhead 99 respectively and a pair of discharge rollers 98 disposed downstream from the printhead 99. The pressure roller 96 is supported at an extremity of a lever member 97 to bring it into contact with the feed roller 94.

In order to allow precise printing up to a position as close as possible to the trailing edge of a sheet S, it is necessary to disposed the pressure roller 96 nearby the printhead 99. For this purpose, the pressure roller 96 has to be small as much as possible in order to avoid the interference with the printhead. Moreover, it is preferred that an extremity 97a of the lever member 97 supporting the pressure roller 96 is extended toward the printhead 99 so as to maintain a precise sheet feeding as long as possible by pressing the sheet with the extremity 97*a* even after the sheet trailing edge has passed through the pressure roller 96. The extension of the extremity 97*a* of the lever member 97 prevents the sheet trailing edge from rising up to interference with the printhead 99.

However, even when the extremity 97*a* of the lever member 97 is attempted to extend toward the printhead 99, it is necessary to keep both a distance between the extremity 97*a* and a path wall 92 facing the extremity 97*a* and a distance between the printhead 99 and the path wall 92 facing the same, equal or superior to a predetermined value, taking the assembly tolerance or the like into consideration. Thus, there is a limitation for the extension of the extremity 97*a*, and it is difficult to ensure a precise sheet feeding to prevent the sheet trailing edge from rising up by using the construction as shown in FIG. 7. In other words, it is impossible to print precisely up to a point extremely nearby the trailing edge of the sheet S.

U.S. Pat. No. 5,527,123 discloses a sheet transport mechanism for an ink jet printer provided with drive rollers and pinch rollers for feeding a sheet into the printing zone. This sheet transport mechanism is provided with an upper guide portion and a lower guide portion for guiding a paper as a printing medium. The upper guide portion includes an extension portion extending in a downward and downstream direction over the paper to contact the paper along a transverse line which is immediately upstream along a printing medium path from the print zone, between the print zone and the drive rollers. The mechanism includes pinch fingers corresponding to respective drive rollers, in order to permit to print at a point as close as possible to a trailing edge of the paper. The pinch finger is made up of plate spring and its extremity is biased onto the outer circumference of the drive roller, and allows to maintain friction contact between the drive roller and the paper. The extremity of the pinch finger is biased onto the outer circumference of the drive roller downstream from a nip between the pinch roller and the drive roller.

SUMMARY OF THE INVENTION

It is an object of the present invention to provide a printer allowing to guide precisely a sheet of paper fed by a feed roller and a pressure roller as close as possible to a nozzle of a printhead, preventing the sheet from rising up toward the printhead, and thereby allowing printing to take a place at position which is nearer to a bottom of the sheet.

According to the present invention, a printer is provided, which is comprises:

- a feed roller;
- a pressure roller for pressing a sheet of paper against the feed roller to feed the sheet downstream;
- a lever for supporting the pressure roller;
- a printhead disposed downstream from the feed roller and the pressure roller; and
- an elastic sheet guide plate, a portion of which is affixed to the lever, and which guides the sheet to the printhead; wherein the guide plate extends from an end portion of the lever to a position just before the printhead, and contacts with the feed roller upstream from a nip formed between the feed roller and the pressure roller.

The printer of the present invention is provided with an elastic guide plate whose end portion is affixed to a lever supporting a pressure roller. The guide plate comes into contact with a feed roller upstream from a nip defined by the feed roller and the pressure roller. For this contact between the guide plate and the feed roller, the sheet of paper fed from upstream reaches a contact point P between the feed roller and the guide plate, before entering the nip between the feed roller and the pressure roller (refer to FIG. 4). At this time, the feed roller stops or rotates in the opposite direction of the sheet feed direction, thereby the inclination of the sheet leading edge with respect to the sheet feed direction is corrected (sheet leading edge registration). Next, the feed roller rotates in the sheet feed direction and the sheet is fed into the nip formed between the feed roller and the pressure roller. After having passed through this nip, the sheet is fed to the printing zone of the printhead while being guided by the guide plate. Here, as the guide plate extends from the end portion of the lever to a position just before the printhead, the trailing edge of the sheet is prevented from interfering with the printhead after leaving from the nip formed between the pressure roller and the feed roller. Consequently, the trailing edge of the sheet will not be soiled with ink, and it allows printing with an excellent print quality to take place at position as close as possible to the sheet trailing edge. To make this more effective, the guide plate preferably extends to the point just before an ink jet face formed on the printhead.

The guide plate can be easily extended to the position just before the ink jet face of the printhead by forming it with a polymer film, for example, polyethylene terephthalate film or the like. Moreover, the film thickness may be 0.1 mm to 0.30 mm, considering the thickness of the sheet to be printed, the clearance between the printhead and the wall of the sheet transport path, and the elasticity of the film material and the like.

The lever may be made so as to yaw (swing) around a yawing (swinging) shaft parallel with the pressure roller shaft, which is located upstream in the sheet feed direction of the feed roller and the pressure roller and to a side of the pressure roller with respect to the sheet feed path. The pressure roller may be rotatably supported with one end of this lever, while the other end may be provided with a bias member for biasing the lever to yaw around the yawing shaft in such direction that the pressure roller biases the feed roller.

In the printer according to the present invention, the pressure roller may be defined as a plurality of pressure rollers and the guide plate may be defined as a plurality of guide plates. The plurality of pressure rollers are disposed on the feed roller with a certain interval. Each guide plate may extend from upstream to downstream from the nip formed between by the feed roller and the pressure roller such that the guide plate can pass through and between respective adjacent pressure rollers.

The printer according to the present invention may further comprise a sheet path wall facing the printhead and, the extension line of an extremity of the guide plate may be intersect the path wall with an acute angle. By this construction, the leading edge of a sheet fed by the feed roller and the pressure roller is directed to the path wall and fed substantially in a close contact state with this path wall.

The printer according to the present invention may further comprise a pair of discharge rollers for pinching and discharging the printed sheet. The extremity of the guide plate may be positioned to a side of the sheet path wall with respect to a line connecting the nip defined between the feed roller and the pressure roller and the nip defined between the pair of discharge rollers. By adjusting the angle of the extremity of guide plate in the above mentioned manner, the leading edge and the trailing edge of a sheet fed by the feed roller and the pressure roller can be prevented more effectively from rising up toward the printhead and coming into contact with the printhead.

DETAILED EXPLANATION OF THE PREFERRED EMBODIMENTS

Figure 1:
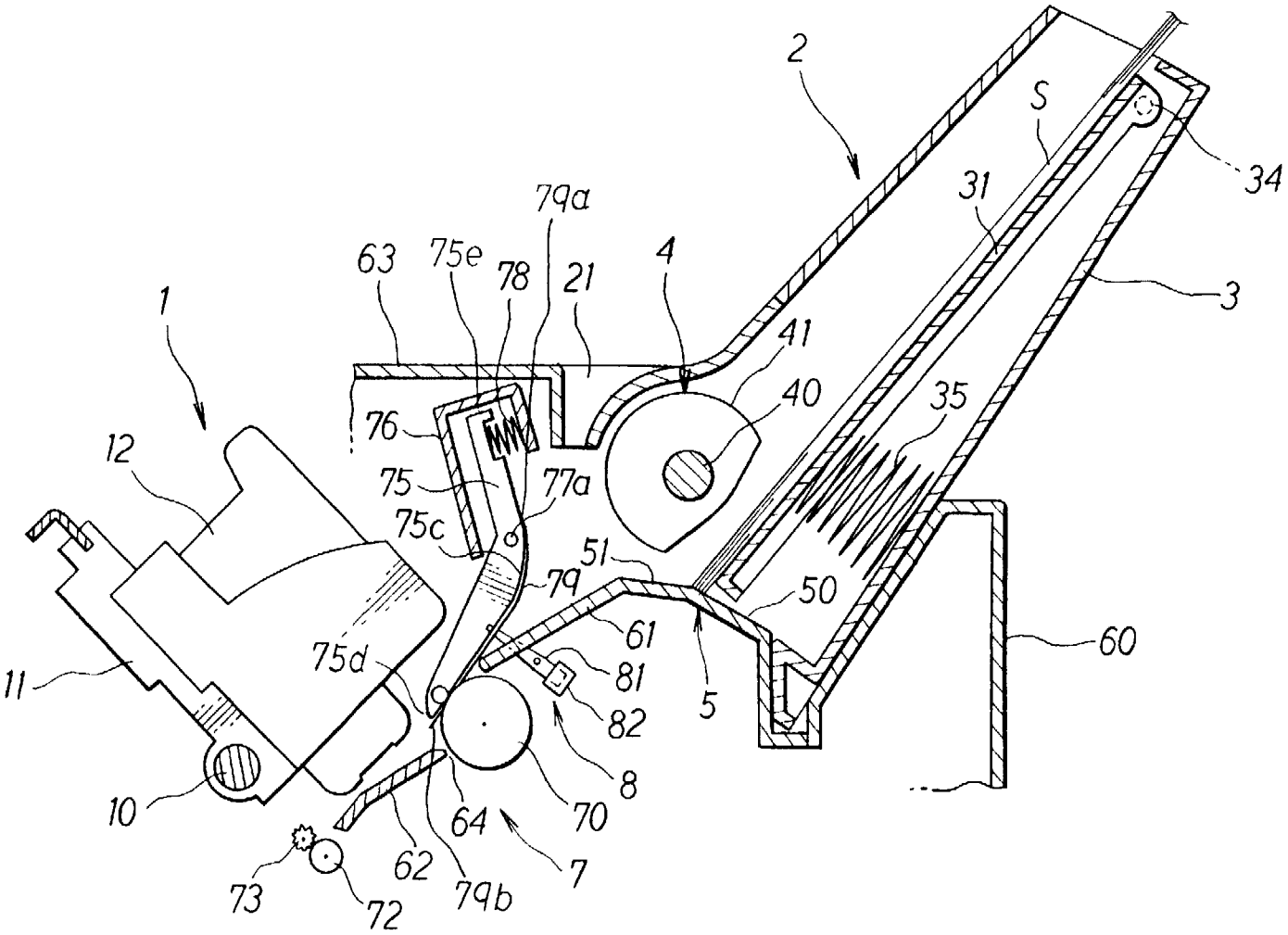
FIG. 1 is a longitudinal cross portion view of essential parts of a printer embodying the present invention.

The present invention will be described referring to drawings of an ink jet type printer embodying the present invention thereinafter.

This printer feeds sheets one by one from a sheet conveying unit 2, and further feeds a sheet S in front of a printing mechanism 1 by a sheet feed unit 7. After performing printing on the sheet S by printing unit 1, the sheets is discharging from the printer. The sheet S is a so-called cut paper cut into a rectangle of a predetermined format.

The printing mechanism 1 comprises a carriage 11 reciprocating along a guide rail 10, an ink cartridge 12 supported with the carriage 11 and a printhead 13. The guide rail 10 is disposed in the transverse direction of the sheet S supplied with the sheet conveying unit 2, in other words, in the direction parallel with the surface of the sheet S and orthogonal to the feed direction of the sheet S. During the printing, the carriage 11 being reciprocated by a driving source, not illustrated (see motor 103 of FIG. 5), the printhead 13 ejects ink droplets toward the sheet S passing through thereunder, thus printing images composed of characters and graphics on the sheet S.

The sheet conveying unit 2 comprises a hopper 3 for storing the sheet S in a stacked state, a conveying mechanism 4 for conveying the sheet S from the hopper 3, and a wall portion 5 disposed so that the sheet S fed from the hopper 30 runs against it. A pushing-up plate 31 is disposed in the hopper 3 to stack and support the sheet S. The pushing-up plate 31 is rotatable around a rotation shaft 34 disposed at the rear end side of the hopper 3 and a spring 35 biases the leading edge side of the sheet S so as to be pushed up towards the conveying mechanism 4.

The conveying mechanism 4 comprises a support shaft 40 parallel with the transverse direction of the sheet S, and the conveying (separating) rollers 41 mounted on the support shaft 40. A sheet reception face 50 for receiving the sheet S descending from the leading edge of the hopper 3 and a slope face 51, continuing over the sheet reception face 50, rising up as it advances forward in the feed direction from the hopper 3 are formed on the wall portion 5. The slope face 51 performs a function of separating one by one sheets of paper S fed from the hopper 3. On the slope face 51, a friction member or other known separation member may conveniently be disposed together.

The sheet conveying unit 2 is further provided with an insert inlet 21 for manually feeding sheet on the top face of a cover member 63 composing the outer shell of the printer. The manual feed insert inlet 21 opens downstream the feeding mechanism 4 and downstream the sheet feed unit. 7.

The sheet feed unit 7 includes a feed roller 70 and a pressure roller 71 disposed upstream from the printing mechanism 1 respectively, a lever member 75 supporting the pressure roller 71, a pair of discharge rollers 72, 73 disposed downstream from the printhead 13, path walls 61, 62 for defining the sheet path, and a sheet detector 8 or the like. The path walls 61, 62 is formed in a portion of a printer frame 60 supporting the hopper 3, the feeding mechanism 4 and the printing mechanism 1, and extends to a position facing the printhead 13 continuously from the sheet reception face 50.

Figure 2:
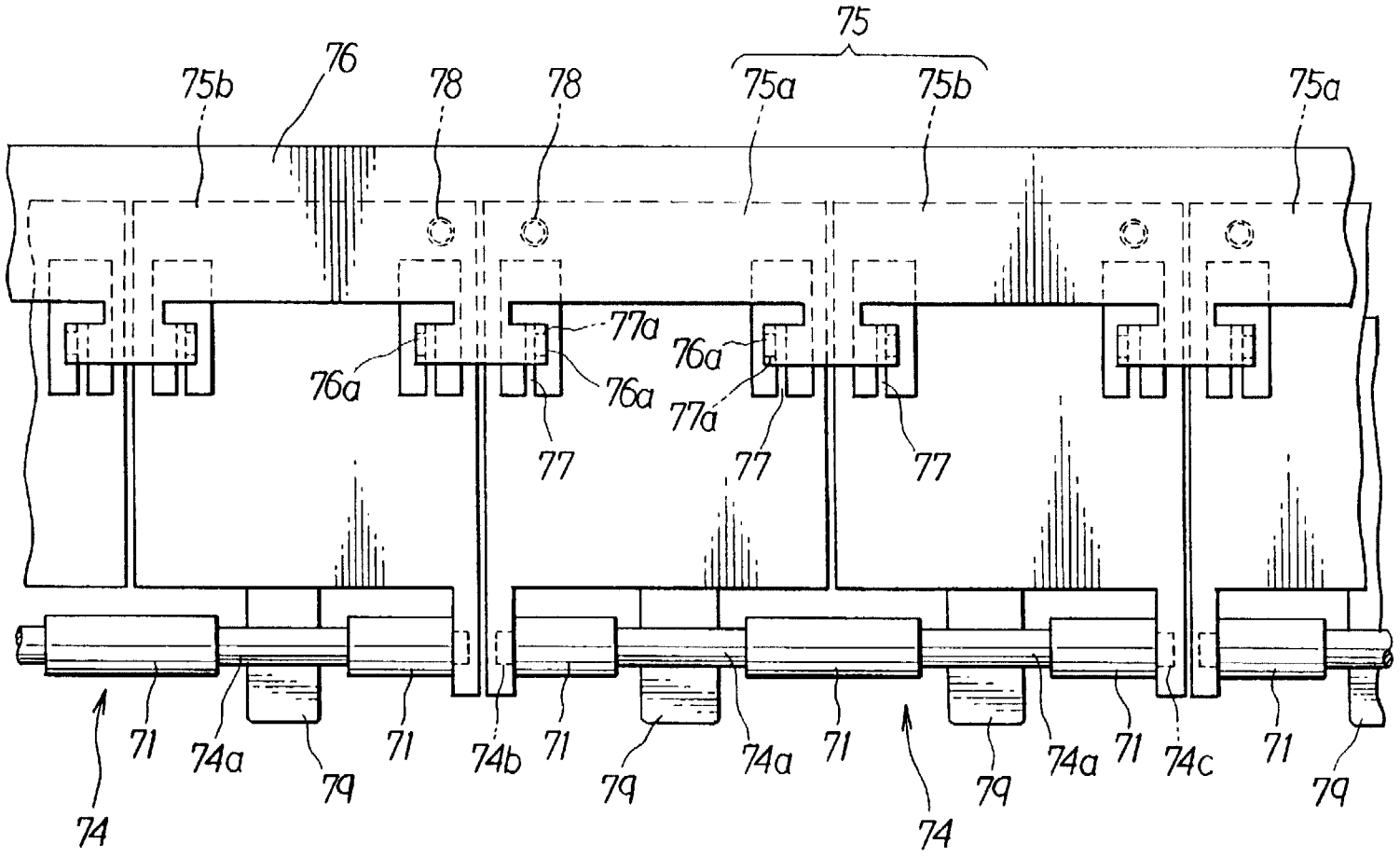
FIG. 2 is a partial front view of the portion of pressure roller 71, lever member 75 and attachment member 76.

The feed roller 70 is disposed rotatably around a axis line parallel with the transverse direction of the sheet S, its essential portion being positioned under the path walls 61, 62, and a part of its top face is exposed from an opening 64 between these both path walls 61, 62. A plurality of pressure rollers 71 are disposed in the transverse direction of the sheet on a plurality of bar members 74 as shown in FIG. 2, and comes into contact respectively with the exposed portion of the feed roller 70. An appropriate number, for example three, pressure rollers 71 are formed with given intervals on each bar member 74, and a smaller diameter portion 74*a* is formed between respective rollers.

Respectively one pair of lever members 75 supporting the pressure rollers 71 is disposed for each bar member 74, and one of the pair 75*a* supports rotatably a shaft portion 74*b* at the one end of the bar member 74, while the other of the pair 75*b* supports rotatably a shaft portion 74*c* at the other end of the bar member 74. The respective portions 75*a*, 75*b* are supported as described below, with an attachment member 76 independently each other so as to yaw.

Figure 3:
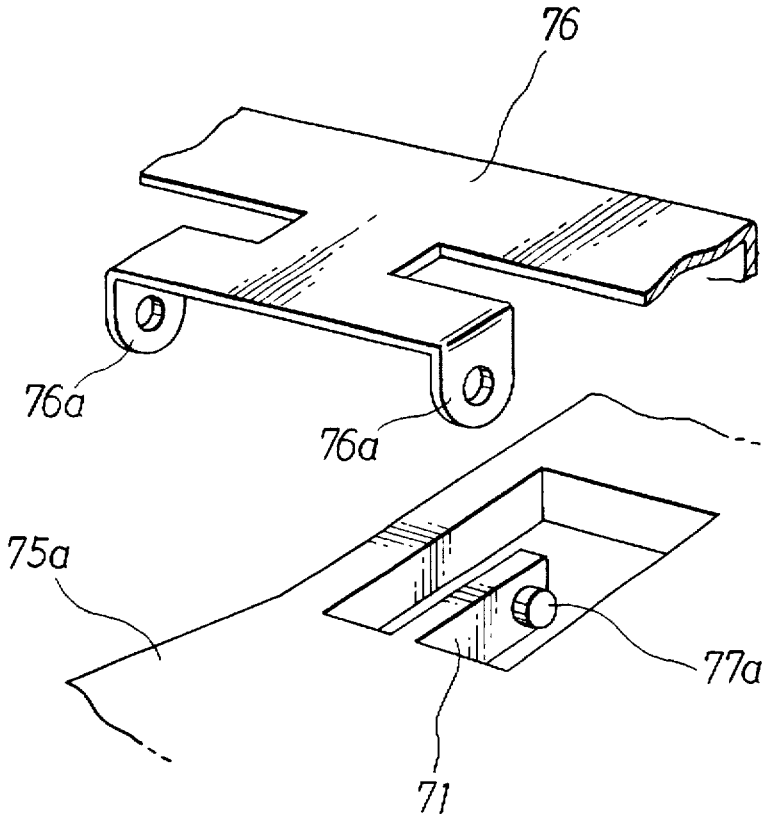
FIG. 3 is a perspective view showing the construction for supporting the lever member 75 by the attachment member 76.

The attachment member 76 is formed in an elongated shape in the transverse direction of the sheet, as shown in FIG. 2 and FIG. 3, and includes a pair of support pieces 76*a* for each portion 75*a*, 75*b* with a given interval longitudinally. The respective portions 75*a*, 75*b* are supported so as to allow to yaw, by protruding a shaft 77*a* from an arm 77 disposed in the proximity of its both right and left sides, and fitting the shaft 77*a* into a bearing hole of the support piece 76*a* using the elasticity of the arm 77. The center of this yawing is an axis line, positioned upstream the sheet feed direction of both rollers 70, 71, to the opposite side to the feed roller 70 with respect to the sheet path, and besides parallel with the feed roller 70. In this case, the arm 77 and the shaft 77*a* may also be formed to a side of the attachment member 76, and the bearing hole may be formed to a side of respective portions 75*a*, 75*b*.

The respective portions 75*a*, 75*b* biases both ends of the bar member 74 independently toward the feed roller 70 by means of a spring inserted between the attachment member 76 and the respective portions 75*a*, 75*b*. Namely, independent of possible unevenness of the outer circumference of the feed roller 70 or sheet thickness variation, the bar member 74 tilts to bring respective pressure rollers 71 into contact with the feed roller 70 equally as much as possible.

The lever member 75 is elbow shaped in its side cross sectional view as shown in FIG. 1 so that one end portion 75*d* positioned downstream, that is, positioned on a side of the pressure roller 71 is disposed as close as possible to the mechanism 1 and the other end portion 75*e* positioned on a side pushed by the spring 78 is raised up in curved direction opposite from the path wall 61. By this shape of the lever member 75, a face 75*c* opposed to the path wall 61 defines a sheet path for directing the leading edge of a sheet fed from the sheet conveying unit 2 to the rollers 70, 71 in cooperation with the path wall 61.

An elastic guide piece 79 which is in form of thin board is affixed to the respective portions 75*a*, 75*b* of the lever member 75. The guide piece 79 is composed of film material made up of resin, such as polyethylene terephthalate, or plate spring. One end 79*a* of the guide piece 79 is stuck to a position, of the lever member 75, which is raised up in the curved direction opposite from the path wall 61 and which is positioned close to the end portion 75*e* of the lever member 75.

Figure 4:
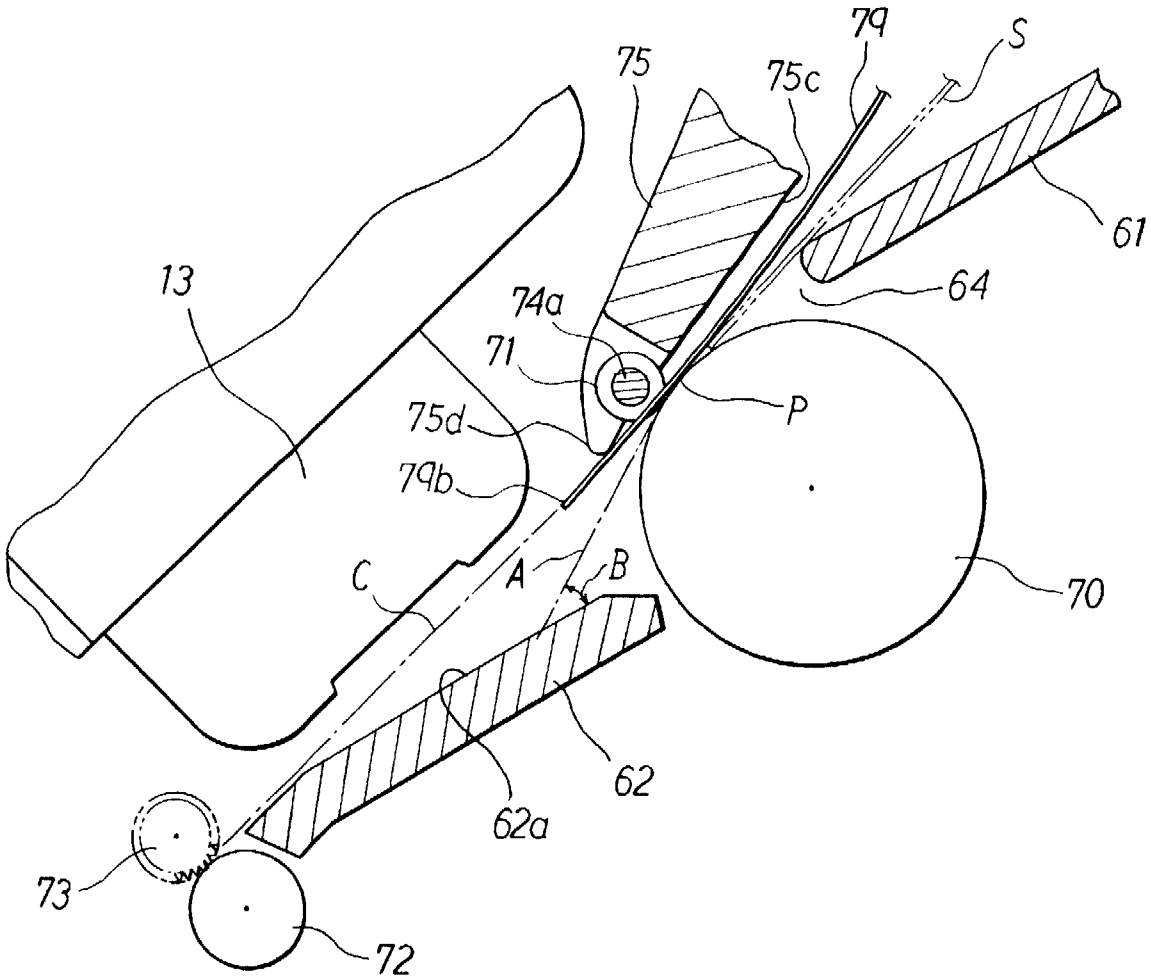
FIG. 4 is a partial enlarged view of the sheet feed unit 7 of FIG. 1.

As shown in FIG. 4, the free end 79*b* of the guide piece 79 is protruded downstream from the end portion of the lever member 75 so that the guide piece 79 passes through a smaller diameter portion 74*a* of the bar member 74 between the pressure rollers 71. The thickness of the guide piece 79 may be in the range of about 0.1 mm to about 0.3 mm. The guide pieces 79 is urged by means of its elasticity to contact with the upper face of the feed roller 70 at a contact point P upstream from the pressure roller 71 in order to form a nip portion for registering the sheet leading edge, between the guide piece 79 and the feed roller 70. The guide piece 79 is stuck to a place which is recessed from the surface of the lever member 75, and protrudes from the surface of the recessed portion toward the feed roller 70 curving with a small angle.

The path wall 62 which is located downstream from the rollers 70, 71 forms a so-called platen face opposed to the printhead 13. The path wall 62 has a slope face 62*a* which is inclined so that the end portion nearby the roller 70 is farther from the printhead 13. The contact point portion (or nip) of a pair of discharge rollers 72, 73 is positioned at the almost same height as the upper end (downstream end) of the slope face 62*a*. The upper roller 73 of the pair of discharge rollers 72, 73 is a so-called spur roller disposing a number of sharp protuberances on the outer circumference thereof.

The pressure roller 71 comes into contact with the feed roller 70 downstream from a contact point of the feed roller 70 with a straight line which is tangent to the outer surface of the feed roller 70 and passes through a contact point (or nip) between the pair of discharge rollers 72, 73. As the result, a tangent A passing through a contact point of both rollers 70, 71 intersects downwardly the slope face 62*a* such that the tangent A forms an acute angle B with the slope face 62*a*. The guide piece 79 also tilts downwardly so as to form an acute angle with the slope face 62*a*. The guide piece 79 further inclines downwardly in respect of a line C connecting the contact point between the rollers 70, 71 and the contact point between the pair of discharge rollers 72, 73. The lower end 79*b* of the guide piece 79 protrudes with respect to the line C to the side of the slope face 62*a*.

Consequently, the leading edge of the sheet fed from the rollers 70, 71 comes into contact with the slope face 62*a* with an acute angle, and advances substantially in a close contact with this slope face 62*a* until the leading edge of the sheet is pinched between the pair of discharge rollers 72, 73. The sheet extending between the rollers 70, 71 and the pair of discharge rollers 72, 73 is kept stretched along the line C, because the pair of discharge rollers 72, 73 is set so as to feed the sheet at a velocity slightly higher than the rollers 70, 71. When the sheet trailing edge is released from the rollers 70, 71, the trailing edge is guided by the guide piece 79 up to a position extremely nearby the printhead 13, more particularly up to its jet face, in such a manner that the trailing edge does not interfere with the printhead 13. By providing the guide piece 79 on the sheet feed unit 7, the sheet leading and trailing edges are prevented from rising up and touching the printhead, thereby prevented ink from soiling it. As the result, this printer makes possible to achieve a high quality printing at a position further nearer the sheet trailing edge.

Figure 5:
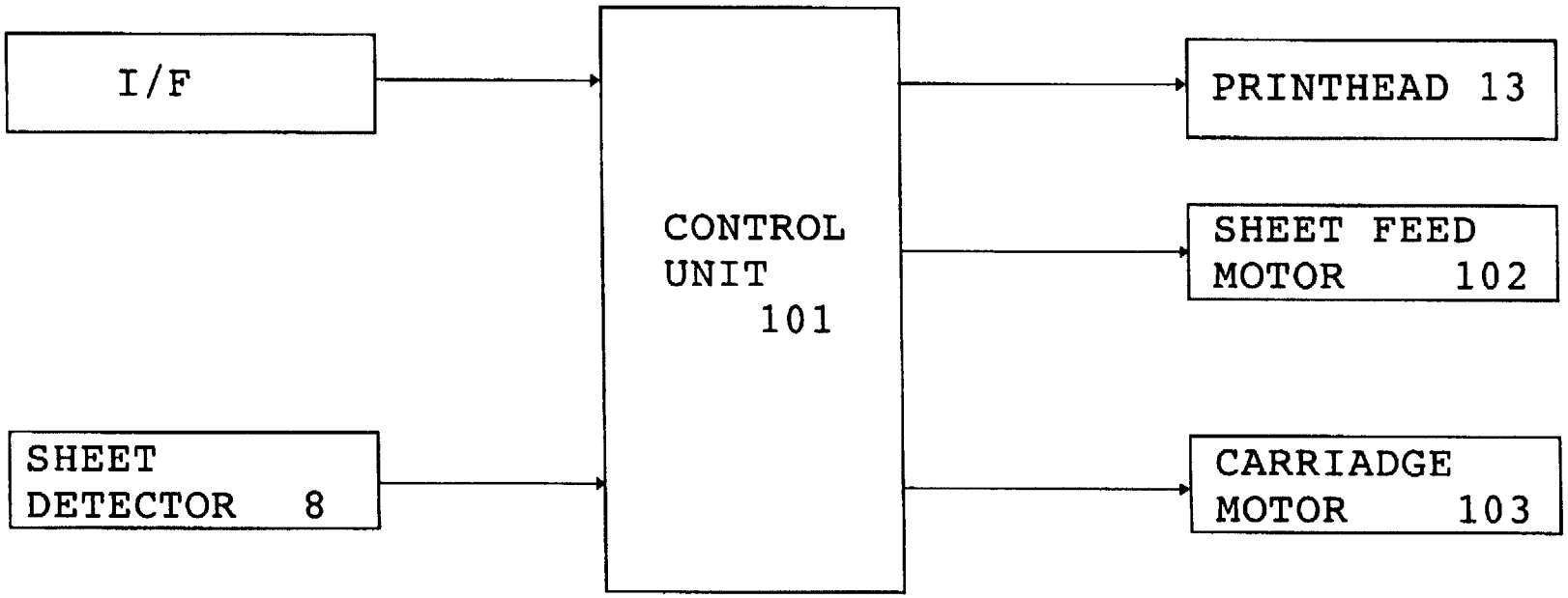
FIG. 5 is a block diagram showing the outline of the electric construction of a printer in the embodiment.

FIG. 5 is a block diagram showing the outline of the electric composition of the printer. The control unit 101 is composed of well-known CPU, ROM, RAM or the like, and drives the printhead 13, a sheet feed motor 102 and a carriage motor 103 based on data received through an I/F portion. A sheet detector 8 is composed of a lever 81 protruding in the sheet path upstream from the rollers 70, 71 and a switch 82 operated by this lever 81, as shown in FIG. 1, and informs to a control unit 101 presence/absence of a sheet in the path.

Figure 6:
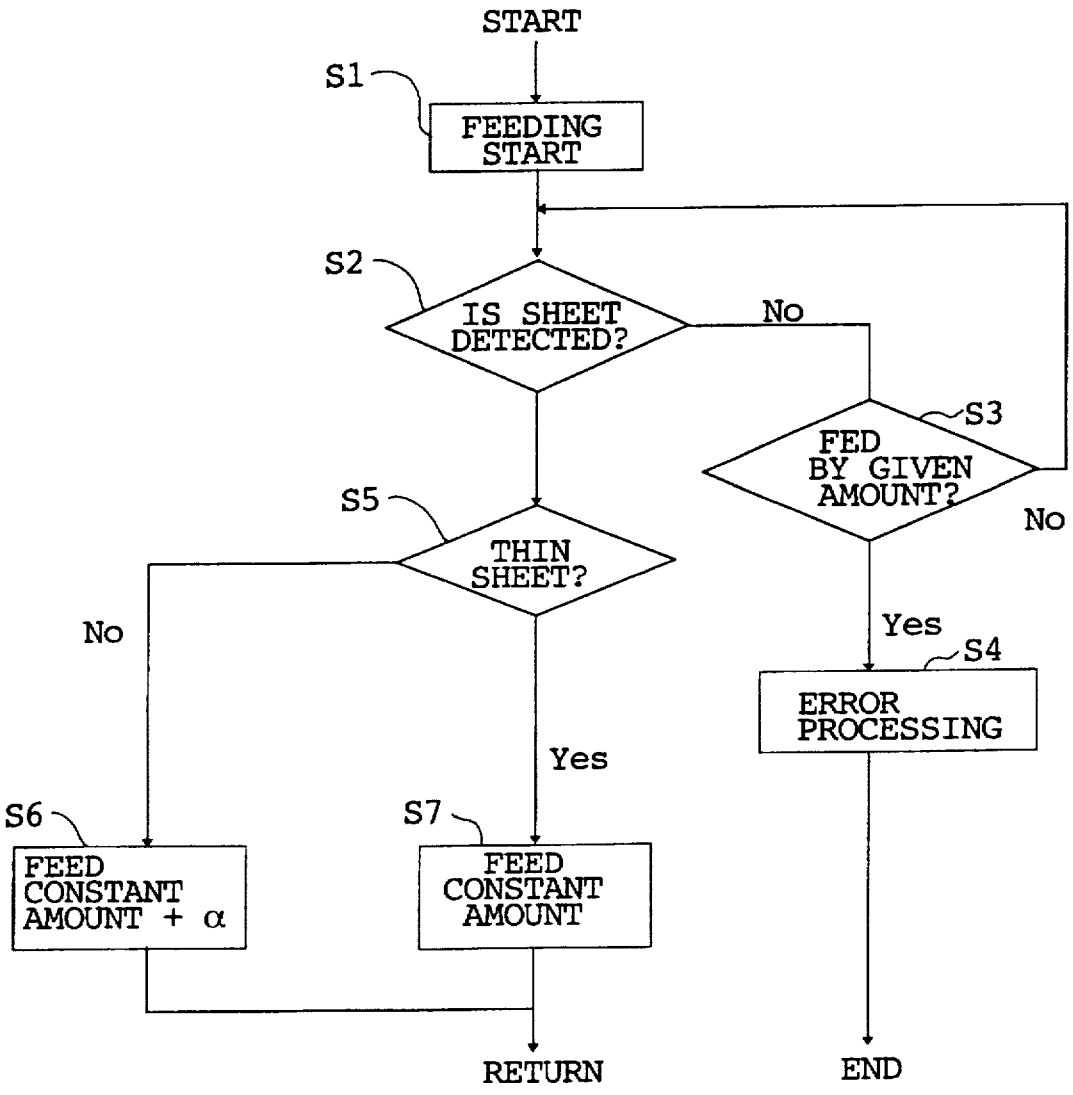
FIG. 6 is a flow chart showing the control content for sheet entrance.
Figure 7:
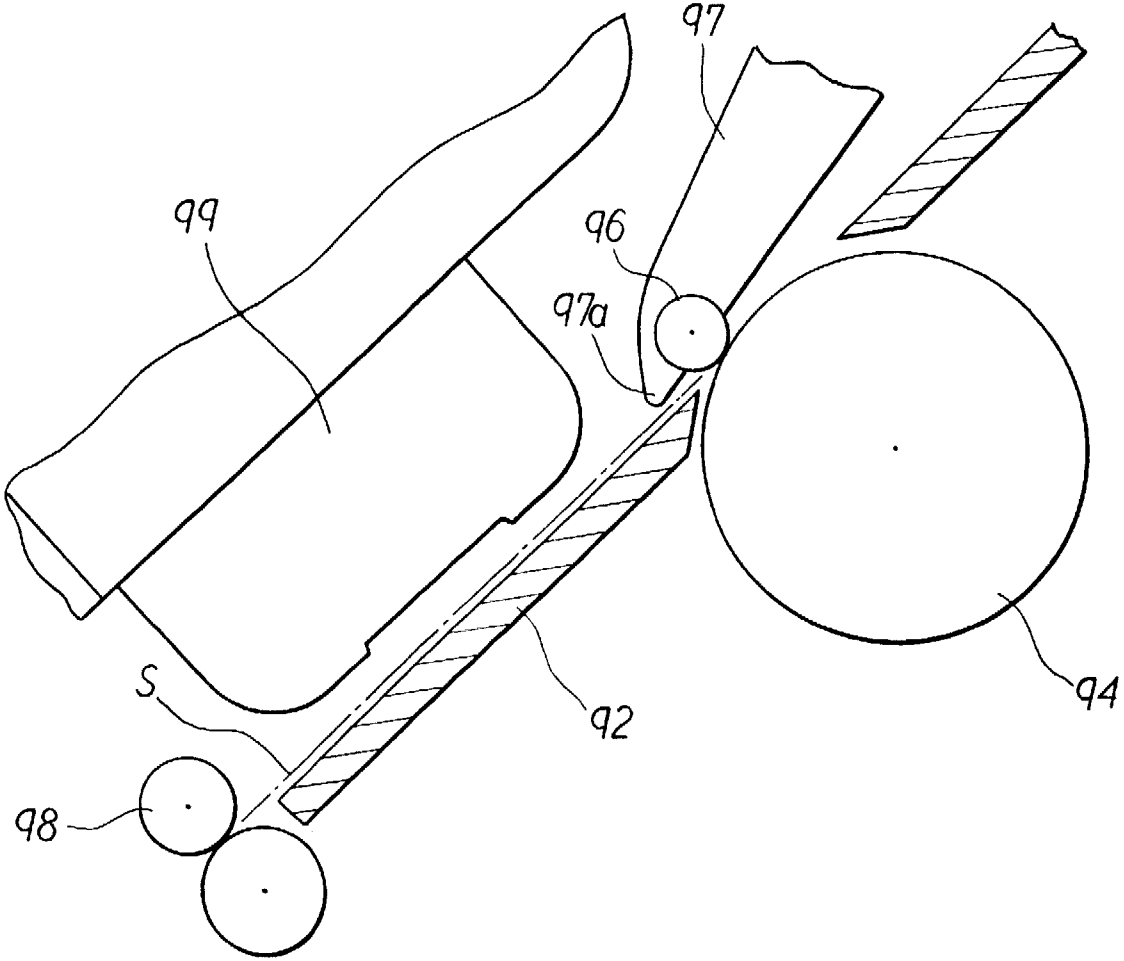
FIG. 7 shows a sheet feed unit of a conventional printer corresponding to FIG. 4.

FIG. 6 is a flow chart showing an operation steps of the control unit 101 for feeding a sheet from the sheet conveying unit 2 to a print start position. Upon receiving a feeding signal from a host unit such as PC, the control unit drives the sheet feed motor 102 to start the sheet feeding (S1). First, the sheet feed motor 102 rotates the sheet conveying roller 41 clockwise in FIG. 1, to feed one sheet S from the hopper. The leading edge of the sheet S enters the sheet path between the face 75*c* of the lever member 75 or the guide piece 79 and the path wall 61 to be guided by them. The entrance of the sheets activates the sheet detector 8. After that, the sheet S is registered at the nip portion between the feed roller 70 and the guide piece 79 (see FIG. 4). At this time, the motor 102 stops the rollers 70, 72 or rotates counterclockwise, and does not feed the sheet S downstream from the registration position.

The motor 102 rotates by an angle corresponding to a distance from the hopper 3 to the registration position then changes over the rotation direction to rotate the rollers 70, 71 clockwise after stopping the sheet conveying roller 41. As the result, while being pressed by the guide piece, sheet is fed toward the pressure roller 71 by the feed roller 70, pinched between these rollers 70, 71, and fed toward the printhead 13. During the above mentioned operation, if the sheet detector 8 has detected a sheet (S2:Yes), the control unit 101 distinguishes the data concerning a type of the sheet received from the host unit (S5) and, if it is an ordinary thin paper (S5:Yes), rotates the motor 102 by a constant amount from the registration position to move the first printing position of the sheet S to a position opposed to the printhead 13 (S7). If it is a thick paper such as postcard, envelop, or the like (S5:No), as the leading edge is introduced by less distance into the nip between the feed roller 70 and the guide piece 79, the motor 102 rotates by the constant amount+α amount to make it possible to move the first printing position of the sheet S having the same upper margin as the thin sheet to a position opposed to the printhead 13 (S6).

In other words, the control unit 101 stores previously in the ROM the leading edge feeding amount of the sheet (the constant amount for thin paper, and the constant amount+α amount for thick paper) from the registration position toward the printing mechanism 1 depending on the sheet type, reads the leading edge feeding amount out according to a signal indicating the sheet type, and controls the leading edge positioning substantially constant independent of the sheet type. The amount a mentioned above is determined according to the diameter of the feed roller 70 and the elastic force of the guide piece 79 or others. The sheet type can not only b e determined into two types, but also into multiple stages.

If the sheet detector 8 does not detects a sheet (S2:No, S3:Yes), even when the motor 102 rotates by a distance equal or superior to that from the rotation start of the sheet conveying roller 41 to the registration position, an error processing will be performed (S14) judging that the sheet has jammed or the hopper 3 is empty, and terminates the control.

When a sheet is inserted from the manual feed insert inlet 21 and the sheet leading edge is situated at the registration position, as the sheet is detected (S2:Yes) at the beginning of the sheet insertion, the motor 102 does not rotates the sheet conveying roller 41, but rotates the rollers 70, 72 clockwise as mentioned above by an amount corresponding to the sheet type (S6, S7).

If a sheet is entered normally, even after the line sending due to the printing operation proceeds and the sheet trailing edge has passed through the sheet detector 8, the control unit 101 continues the printing operation supposing that the sheet still exists until having fed the sheet by a given distance, and prints nearby the sheet rear end. The margin of the sheet trailing edge can be set conveniently, but by pressing the sheet with the guide piece 79, the sheet trailing edge is prevented from rising up even when it is released from the pressure roller 71, allowing precise printing to take place at a position extremely nearby the trailing edge (bottom of the sheet).

As the guide piece 79 is elastic, its elastic deformation permits to guide the sheet precisely even if the position of the free end shifts to some extent. Moreover, as the guide piece 79 has elasticity, the guidance will not be disturbed even if the lever member 75 slightly moves up and down according to the rotation of the feed roller, due to an uneven surface of the feed roller 70 or the variation in sheet thickness.

In addition, as the pressure roller 71 and the guide piece 79 are disposed in the transverse direction of the sheet with a convenient interval, the sheet feeding by the pressure roller, and the pressing effect by the guide piece mentioned before can be achieved all across the sheet width, allowing accurate feeding of not only the leading edge but the trailing edge of the sheet without inclination.

What is claimed is:

1. A printer, comprising:

a feed roller;

a pressure roller for pressing a sheet of paper against the feed roller to feed the sheet downstream;

a lever for supporting the pressure roller;

a printhead disposed downstream from the feed roller and the pressure roller; and an elastic sheet guide plate, a portion of which is affixed to the lever, and which guides the sheet to the printhead;

wherein the guide plate extends from an end portion of the lever to a position just before the printhead, and contacts with the feed roller upstream from a nip formed between the feed roller and the pressure roller.

2. The printer according to claim 1, wherein the sheet is registered at the nip formed between the guide plate and the feed roller, before being transported to a printing zone of the printhead.

3. The printer according to claim 2, wherein the sheet registration at the nip defined between the guide plate and the feed roller is performed by the feed roller stopping or rotating in an opposite direction to a sheet feed direction.

4. The printer according to claim 3, wherein an ink jet face is formed on the printhead, and the guide plate extends to a position just before the ink jet face.

5. The printer according to claim 3, wherein the guide plate is made of polyethylene terephthalate film.

6. The printer according to claim 5, wherein the thickness of the film is 0.1 mm to 0.30 mm.

7. The printer according to claim 3, wherein the lever biases the pressure roller toward the feed roller.

8. The printer according to claim 7, wherein the lever is disposed upstream from the feed roller and the pressure roller in a sheet feed path and to a side of the pressure roller with respect to the sheet feed path, and yaws around a yawing shaft parallel with the pressure roller shaft.

9. The printer according to claim 3, the pressure roller is defined by a plurality of pressure rollers, and the guide plate is defined by a plurality of guide plates; wherein the plurality of pressure rollers are disposed on the feed roller with a given interval, and each guide plate extends from upstream to downstream from the nip formed between the feed roller and the pressure roller so that each guide plate passes through and between respective adjacent pressure rollers.

10. The printer according to claim 1, wherein an ink jet face is formed on the printhead, and the guide plate extends to a position just before the ink jet face.

11. The printer according to claim 1, wherein the guide plate is made of polyethylene terephthalate film.

12. The printer according to claim 11, wherein the thickness of the film is 0.1 mm to 0.30 mm.

13. The printer according to claim 1, wherein the lever biases the pressure roller toward the feed roller.

14. The printer according to claim 13, wherein the lever is disposed upstream from the feed roller and the pressure roller in a sheet feed path and to a side of the pressure roller with respect to the sheet feed path, and yaws around a yawing shaft parallel with the pressure roller shaft.

15. The printer according to claim 14, wherein the pressure roller is rotatably supported with one end of the lever, a bias member is provided on the other end thereof, and the lever yaws around a yawing shaft by the bias member in such a direction that the pressure roller biases the feed roller.

16. The printer according to claim 1, the pressure roller is defined by a plurality of pressure rollers, and the guide plate is defined by a plurality of guide plates; wherein the plurality of pressure rollers are disposed on the feed roller with a given interval, and each guide plate extends from upstream to downstream from the nip formed between the feed roller and the pressure roller so that each guide plate passes through and between respective adjacent pressure rollers.

17. The printer according to claim 1, wherein the guide plate is disposed along a face of a sheet feed path of the lever.

18. The printer according to claim 1, wherein a face of a sheet feed path side of the lever has a shape for guiding the sheet to the nip formed between the feed roller and the pressure roller.

19. The printer according to claim 1, further comprising a sheet path wall facing the printhead so that the extension line of an extremity of the guide plate intersects a surface of the sheet path wall with an acute angle.

20. The printer according to claim 1, further comprising a sheet path wall facing the printhead, and a pair of discharge rollers for pinching and discharging a printed sheet, wherein the extremity of the guide plate is positioned in the side of the sheet path wall with respect to a line connecting the nip formed between the feed roller and the pressure roller and a nip formed between the pair of discharge rollers.

21. The printer according to claim 1, which is an ink jet printer.

* * * * *